US007867062B2

(12) United States Patent
Swartz

(10) Patent No.: US 7,867,062 B2
(45) Date of Patent: Jan. 11, 2011

(54) BLADE SHARPENER

(76) Inventor: Ronald Swartz, 247 Morris Turnpike, Newton, NJ (US) 07860

( * ) Notice: Subject to any disclaimer, the term of this patent is extended or adjusted under 35 U.S.C. 154(b) by 0 days.

(21) Appl. No.: 11/738,450

(22) Filed: Apr. 20, 2007

(65) Prior Publication Data

US 2007/0249268 A1 Oct. 25, 2007

Related U.S. Application Data

(60) Provisional application No. 60/793,412, filed on Apr. 20, 2006.

(51) Int. Cl.
*B24B 3/54* (2006.01)

(52) U.S. Cl. ..... 451/175; 451/557; 451/371

(58) Field of Classification Search ..... 451/371, 451/378, 365, 370, 367, 175, 557, 349
See application file for complete search history.

(56) References Cited

U.S. PATENT DOCUMENTS

| | | | | | |
|---|---|---|---|---|---|
| 905,331 | A * | 12/1908 | Larsen et al. | ..... | 415/175 |
| 1,148,303 | A * | 7/1915 | Farrar | ..... | 451/175 |
| 1,368,218 | A * | 2/1921 | Chenette | ..... | 451/175 |
| 2,949,947 | A * | 8/1960 | Story | ..... | 269/147 |
| 4,216,627 | A * | 8/1980 | Westrom | ..... | 451/175 |
| 4,471,951 | A * | 9/1984 | LeVine | ..... | 269/3 |
| 5,431,068 | A * | 7/1995 | Alsch | ..... | 763/82 |
| 7,052,385 | B1 * | 5/2006 | Swartz | ..... | 451/367 |

* cited by examiner

*Primary Examiner*—Robert Rose
(74) *Attorney, Agent, or Firm*—Richard A. Catalina, Jr.

(57) ABSTRACT

A hand-operated blade sharpener providing engagements of a blade by an abrasive stone at pre-selected angles to the blade is disclosed.

10 Claims, 6 Drawing Sheets

BLADE SHARPENER

CROSS-REFERENCE TO RELATED APPLICATIONS

This application claims benefit of U.S. provisional patent application Ser. No. 60/793,412, filed on Apr. 20, 2006, which is herein incorporated by reference.

This application incorporates by reference commonly assigned U.S. patent application Ser. No. 11/392,445.

FIELD OF THE INVENTION

The present invention relates generally to the field of hand tools and, more specifically, to blade sharpeners.

BACKGROUND OF THE INVENTION

It is recognized that there is a difficulty in sharpening or re-sharpening blades, such as for example, knife blades, using hand tools and other means generally known to those skilled in the art. In particular, retention of the correct angular position of a blade relative to an abrasive medium (for example, an abrasive stone) or facilitation of repetitive smooth passes of the blade or the abrasive medium represent challenging tasks for a user of average skills.

Various devices have been suggested to overcome problems associated with sharpening of blades using hand-operated tools; however, despite the considerable effort in the art, further improvements would be desirable.

SUMMARY OF THE INVENTION

One aspect of the invention is a blade sharpener providing, in operation, repetitive engagements of a blade by an abrasive stone at pre-selected angles to the blade. The blade sharpener includes a clamping mechanism adapted for receiving, gripping, and releasing the blade, a sharpening assembly including an abrasive stone unit and a guiding rod coupled to the abrasive stone unit, a bearing module adapted to pivotally support and provide a clearance fit to the guiding rod, and a base. The base is adapted to rotationally secure the clamping mechanism in pre-selected positions and to support the bearing module at a controlled distance from an axis of rotation of the clamping mechanism.

Various aspects and embodiments of the invention are described in further detail below.

The Summary is neither intended nor should it be construed as being representative of the full extent and scope of the present invention, which these and other additional aspects will become more readily apparent from the detailed description, particularly when taken together with the appended drawings.

BRIEF DESCRIPTION OF THE DRAWINGS

To facilitate understanding, identical reference numerals have been used, where possible, to designate identical elements that are common to the figures. The images in the drawings are simplified for illustrative purposes and are not depicted to scale.

The appended drawings illustrate exemplary embodiments of the invention and, as such, should not be considered as limiting the scope of the invention that may admit to other equally effective embodiments. It is contemplated that features or steps of one embodiment may beneficially be incorporated in other embodiments without further recitation.

DETAILED DESCRIPTION OF THE PREFERRED EMBODIMENTS

Figure 1:
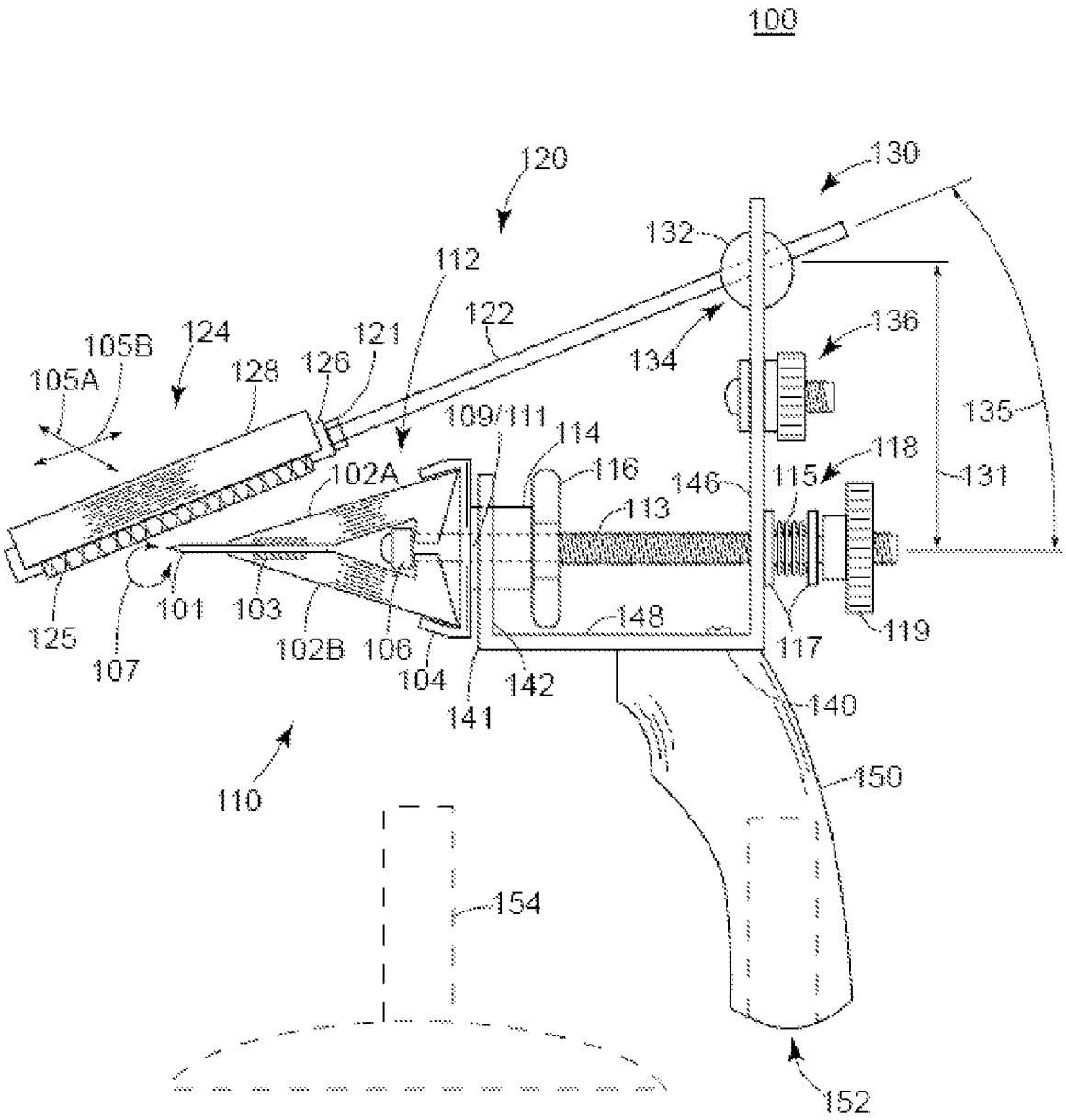
FIG. 1 shows a front view of a blade sharpener in accordance with one embodiment of the present invention.
Figure 2:
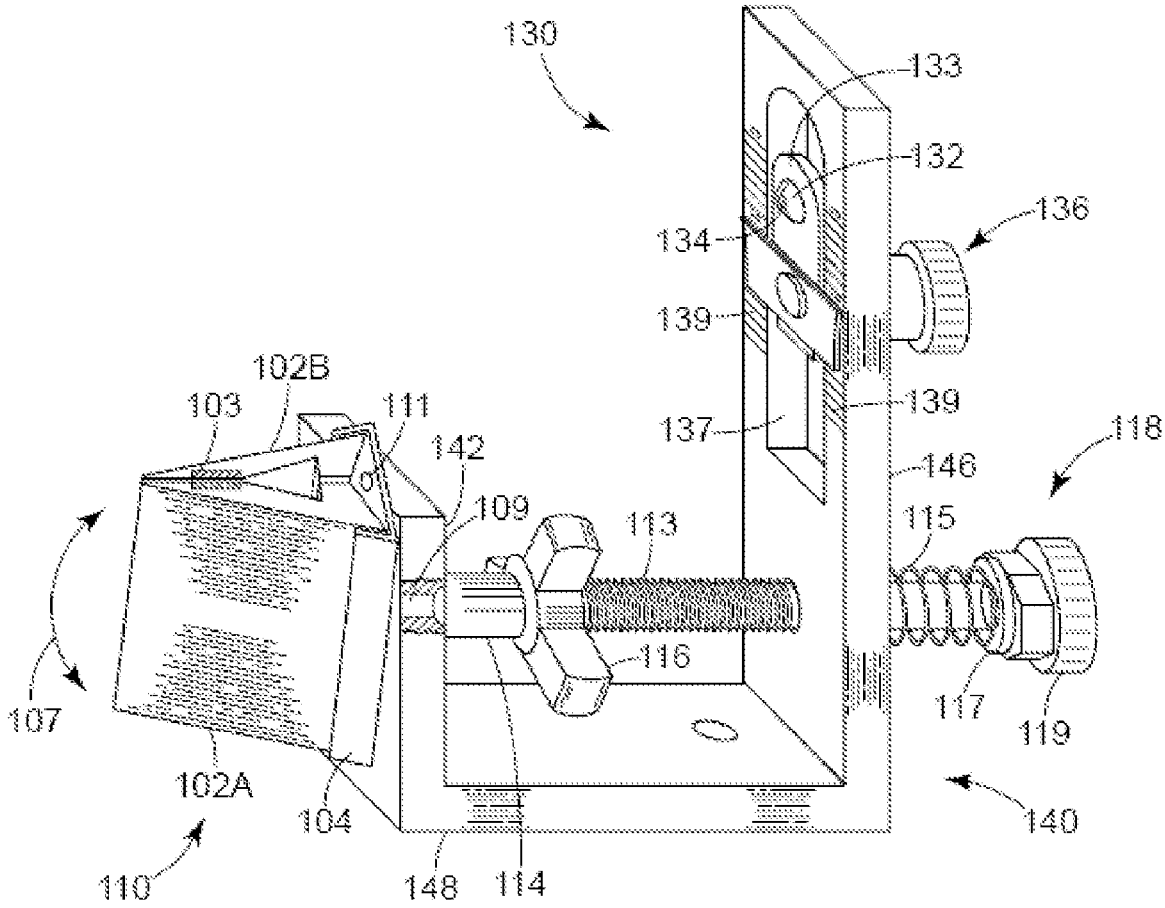
FIG. 2 shows a perspective view of a portion of the blade sharpener of FIG. 1 in an intermediate position of a clamping mechanism of the blade sharpener.

Referring to the figures, FIG. 1 depicts a front view of a blade sharpener 100 in accordance with one embodiment of the present invention, and FIG. 2 depicts a perspective view of a portion of the blade sharpener 100 in an intermediate position of its clamping mechanism.

The blade sharpener 100 generally comprises a rotatable clamping mechanism 110, a sharpening assembly 120, a bearing module 130, a J-shaped base 140, and an optional handle 150. A blade 101 being sharpened (for example, blade of a knife (as shown in FIG. 1), an arrow broadhead, a blade of a tool, and the like) is depicted gripped by jaws of the clamping mechanism 110. Illustratively, the base 140 is manufactured as a single structural element comprising vertical short and long sides 142 and 146 and a horizontal side 148.

Components of the blade sharpener 100 may be fabricated from metals, plastics, and other suitable materials using conventional design considerations known to those skilled in the art of hand tools.

The clamping mechanism 110 generally includes a jaw assembly 112 disposed external to a short side 142 of the base 140, a threaded shaft 113, a cylindrical thrust bushing 114, a wing nut 116, and a compression assembly 118 disposed external to a long side 146 of the base 140. In an alternate embodiment, the wing nut 116 may be substituted by a rotationally controlled threaded member (for example, a combination of a hex nut and a nut driver such as a wrench, and the like).

The jaw assembly 112 comprises tapered jaws 102A and 102B, a jaw housing 104, and a rectangular spacer 106 securing, using a screw 169, the jaw assembly 112 to an end face of the threaded shaft 113. Operable together with the threaded shaft 113 as a screw drive, the wing nut 116 by engaging the thrust bushing 114 forces the jaws 102A, 102B to grip the blade 101. Accordingly, by retracting the wing nut 116 away from the thrust bushing 114, the jaws 102A and 102B may be opened for receiving or releasing the blade 101.

In one embodiment, the jaws 102A and 102B are provided with compressible inserts 103 adapted to form or enhance friction-based contacts between the jaws and the blade 101. In a further embodiment (not shown), to keep the jaws 102A and 102B open during receiving or releasing the blade 101, the jaw assembly 112 may include a wire or flat spring 170 applying a tensile force to the jaws.

The compression assembly 118 is mounted on the threaded shaft 113 and comprises a coil spring 115, thrust washers 117, and an adjusting knob 119. In operation, the coil spring 115 exerts an axial force that pulls the jaw assembly 112 towards an outer surface 141 of the side 142 of the base 140.

The clamping mechanism 110 is rotatably secured in clear coaxial openings formed for the thrust bushing 114 and the threaded shaft 113 in the sides 142 and 146, respectively. The jaw assembly 112 may be rotated, in the directions illustrated with an arrow 107, using the jaws 102A and 102B as a lever.

The side 142 comprised one or more indexers 109 (for example, studs (as shown in FIG. 2), spring-loaded balls, and the like) that protrude through the surface 141 towards the jaw assembly 112. Together with mating elements 111 (for example, indexer-capturing openings (as shown in FIG. 2) or recesses) formed in the jaw housing 104, the indexers 109 facilitate releasable rotational indexing of the jaw assembly 112. Torque required for rotating the jaw assembly 112 is regulated, using the adjusting knob 119, by a pulling force exerted by the coil spring 115.

In one embodiment, the blade sharpener 100 comprises two pairs of the symmetrically disposed indexers 109 and respective mating elements 111, which are adapted for releasably capturing and retaining the jaw assembly 112 in opposing horizontal positions suitable for sharpening particular sides of an edge of the blade 101. In one of such positions, the jaw 102A is disposed above the jaw 102B as shown in FIG. 1, while in the other position (not shown), the jaw 102A is similarly disposed below the jaw 102B.

The sharpening assembly 120 includes a guiding rod 122 and an abrasive stone unit 124. The abrasive stone unit 124 is detachably affixed to the guiding rod 122 (using, for example, a check nut 121) and generally includes an abrasive stone 125 (e.g., sharpening or honing stone), an enclosure 126 releasably supporting the abrasive stone 125, and a handle 128. The handle 128 is adapted for applying, by hand, the abrasive stone 125 to the blade 101. In an alternate embodiment, the handle 128 may be a portion (for example, structural member) of the enclosure 126. In operation, the sharpening assembly 120 may be engaged in movements illustrated using arrows 105A and 105B.

Figure 3:
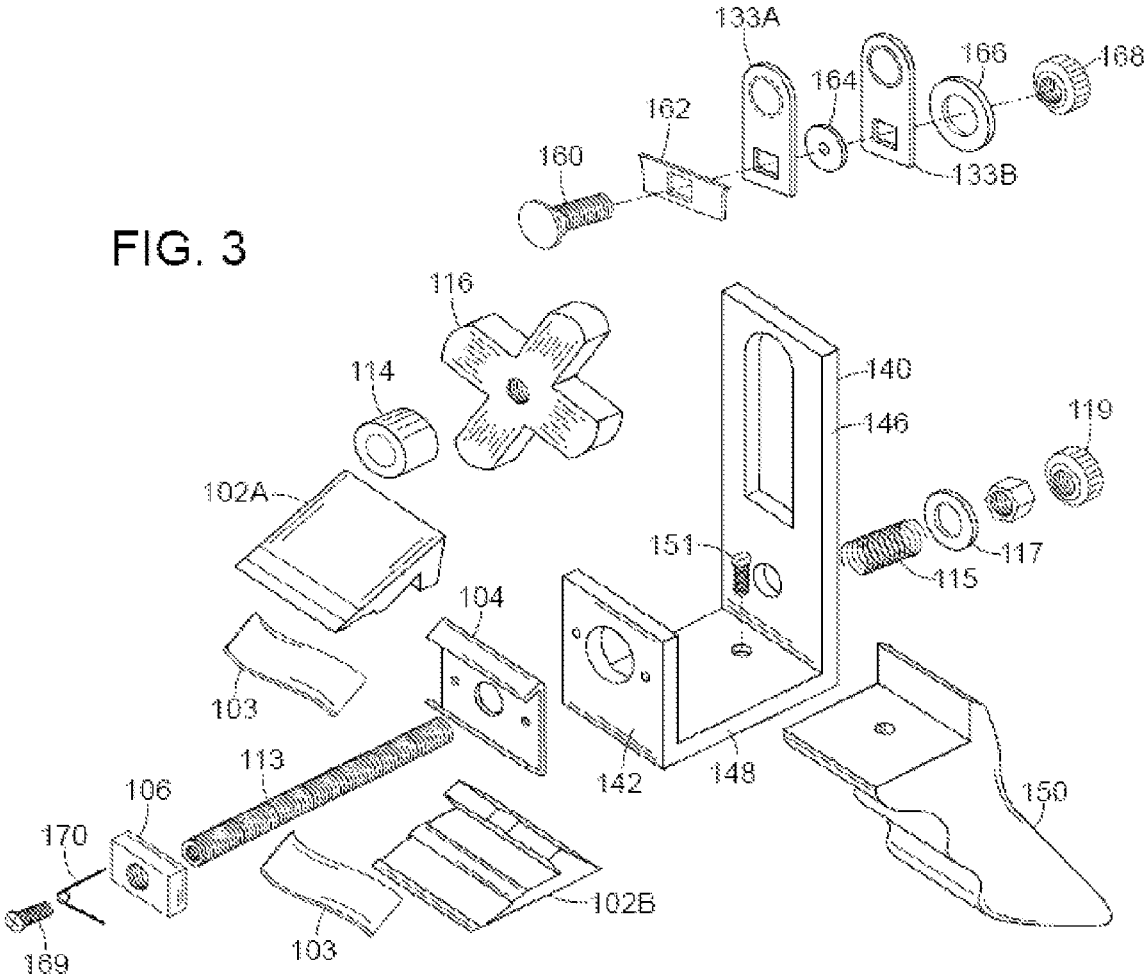
FIG. 3 shows an exploded perspective of a portion of the blade sharpener of FIG. 1.
Figure 4A:
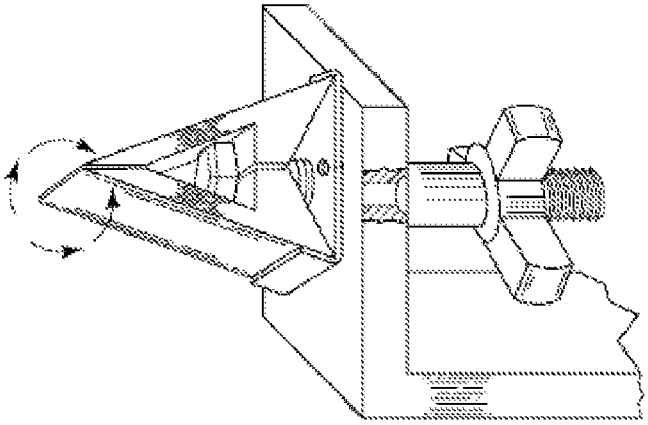
FIG. 4 shows a perspective view of a portion of the blade sharpener of FIG. 1 in an intermediate position of a clamping mechanism of the blade sharpener.
Figure 4B:
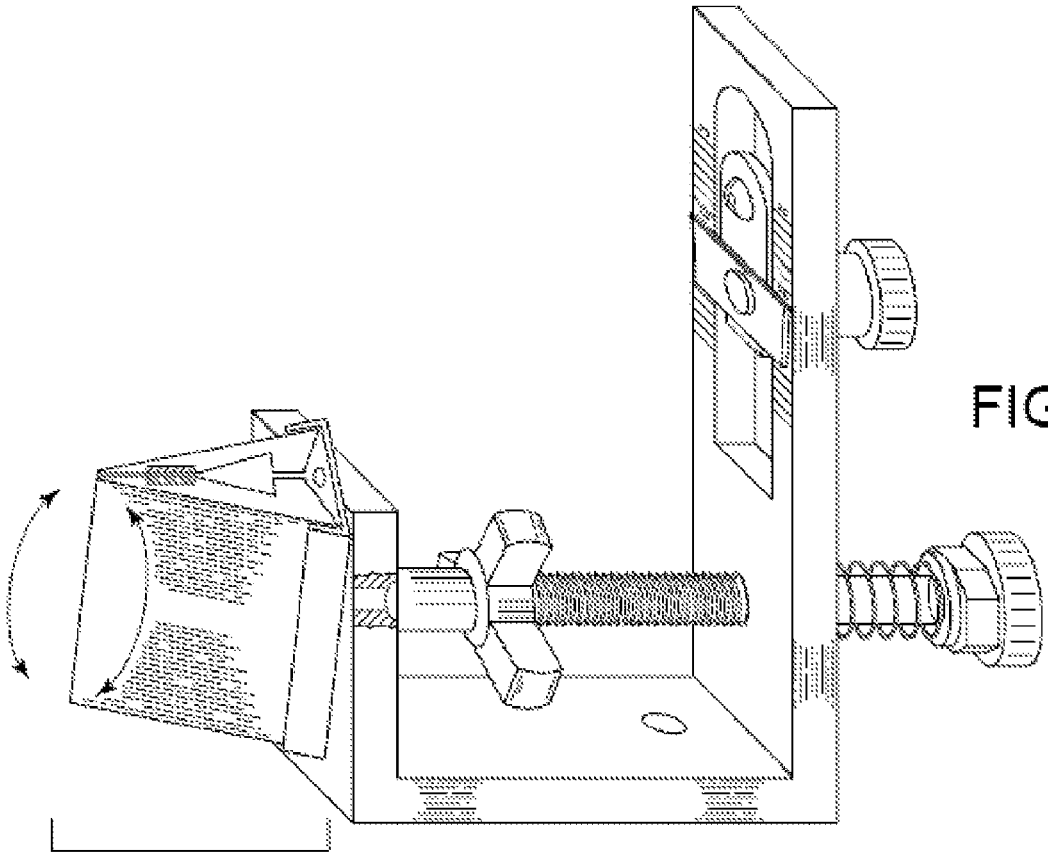
Figure 5:
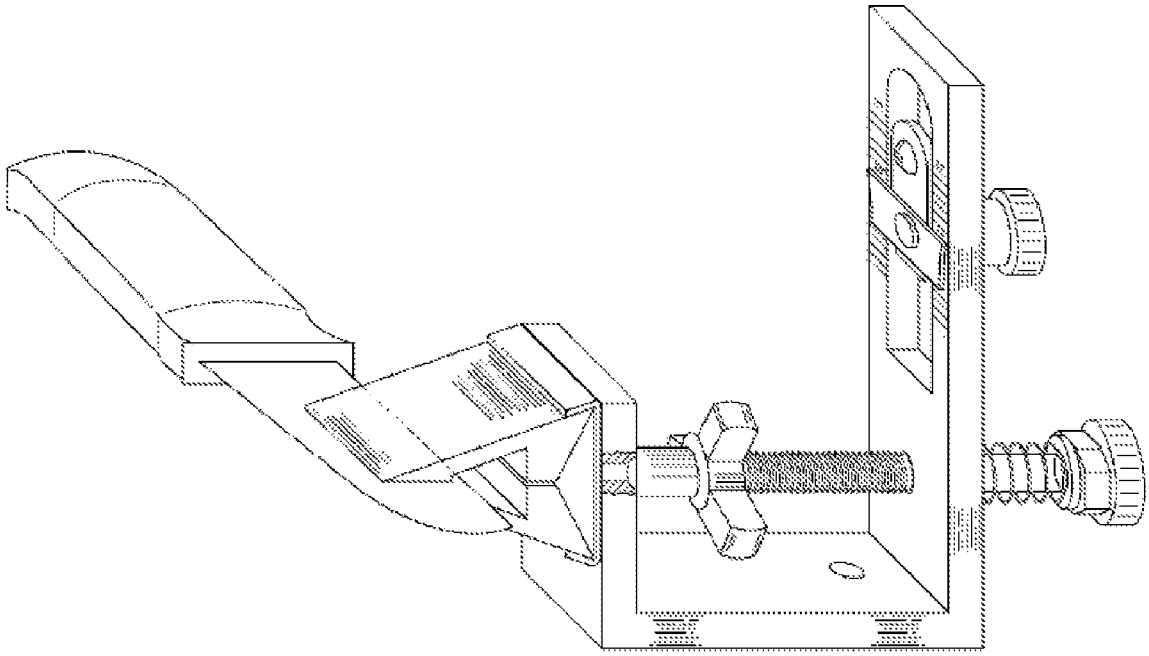
FIG. 5 shows a perspective view of a portion of the blade sharpener of FIG. 1 in a clamped position of a clamping mechanism of the blade sharpener depicting a clamped blade in an operable horizontal position.
Figure 6:
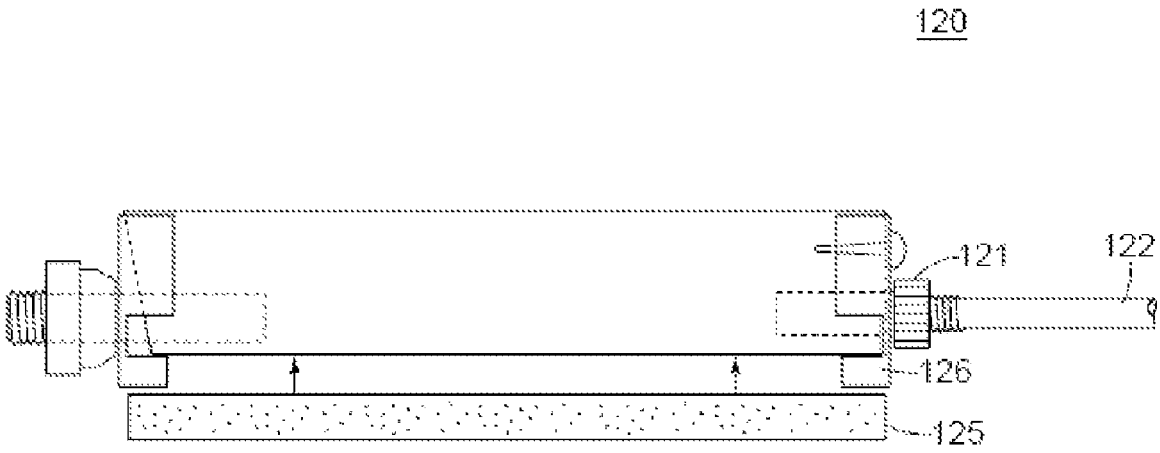
FIG. 6 shows a side view of a portion of the blade sharpener of FIG. 1, the sharpener assembly.

The bearing module 130 comprises a spherical bearing 132 and a retainer assembly 136 movably securing the spherical bearing 132 to the side 146 of the base 140. In the depicted embodiment (shown in detail in FIG. 3), the retainer assembly 136 includes a locking bolt 160, a bracket 162, holders 133A and 133B housing, together, the spherical bearing 132, a spacer 164, a thrust washer 166, and a knob 168.

The spherical bearing 132 has a clear opening 134 (shown in FIG. 1 with broken lines and in FIG. 2) that is adapted for receiving, pivotally supporting, and providing a clearance fit to the guiding rod 124. In the depicted embodiment, the spherical bearing 132 and the holders 133A, 133B are disposed in an elongated cutout 137 formed in the side 146.

The bearing module 130 comprises a spherical bearing 132, a holder 133 (shown in FIG. 2) housing the spherical bearing 132, and a retainer assembly 136 movably securing the holder 133 to the side 146 of the base 140. The spherical bearing 132 has a clear opening 134 (shown in FIG. 1 with broken lines and in FIG. 2) that is adapted for receiving, pivotally supporting, and providing a clearance fit to the guiding rod 124. In the depicted embodiment, the spherical bearing 132 and the holder 133 are disposed in an elongated cutout 137 (shown in FIG. 2) formed in the side 146.

In one embodiment, the side 146 comprises a scale 139 (shown in FIG. 2). The scale 139 (for example, engraved scale) allows disposing the spherical bearing 132 at a controllable (i.e., pre-selected) distance 131 from an axis of rotation of the clamping mechanism 110 (i.e., axis of the threaded shaft 113), thus defining an angle 135 (shown in FIG. 1) at which, in operation, the abrasive stone 125 engages the blade 101.

More specifically, when the sharpening assembly 120 is driven by using the handle 128, the abrasive stone 125 may be engaged, tangentially with respect to the blade 101, in repetitive translational, lateral, or harmonic movements that are performed, in the directions of the arrows 105A or 105B, at the same angle 135 to the blade 101. Using the retainer assembly 136, a user may adjust the angle 135 by varying a position of the clamping mechanism 110 in the cutout 137 (i.e., by varying the distance 131 defined by the scale 139).

In one embodiment, the handle 150 is adapted for holding the blade sharpener 100 by hand (for example, a pistol-grip handle) and may releasably be secured (using, for example, a screw 151) to the horizontal side 148 of the base 140. In a further embodiment, the handle 150 comprises an enforced opening 152 for rotatably mounting the blade sharpener 100 onto an external support 154 (shown in phantom).

In operation, using the wing nut 116, a user secures the blade 101 in the jaw assembly 112 disposed in one of the positions defined by the indexers 109 and elements 111, for example, in a first horizontal position depicted in FIG. 1. Then, the user secures the abrasive stone 125 in the sharpening assembly 120, protrudes a portion of the guiding rod 122 through the opening 134 in the spherical bearing 132, and adjusts location of the bearing module 130 on the side 146 of the base 140 to select the angle 135 between contacting surfaces the abrasive stone 125 and the blade 101 (i.e., adjusts the distance 131 and angle 135).

In operation, the user sharpens the blade 101 by engaging the blade with the abrasive stone 125 and, in case of double-edged blades, rotates the jaw assembly 112, about the axis of rotation of the clamping mechanism 110, in a second horizontal position opposing the first horizontal position.

Although the invention herein has been described with reference to particular illustrative embodiments, it is to be understood that these embodiments are merely illustrative of the principles and applications of the present invention. Therefore numerous modifications may be made to the illustrative embodiments and other arrangements may be devised without departing from the spirit and scope of the present invention, which is defined by the appended claims.

What is claimed is:

1. A blade sharpener, comprising:

a sharpening assembly comprising an abrasive stone unit and a guiding rod coupled to the abrasive stone unit;

a controllably moveable bearing module adapted to pivotally support the sharpening assembly and provide a clearance fit to the guiding rod;

a spring-loaded clamping mechanism adapted to receive, grip, and release a blade, said clamping mechanism:

engageable using a screw drive which axis of rotation coincides with an axis of rotation of the clamping mechanism and is substantially coplanar with an axis of the guiding rod;

rotateable at least 360 degrees about the axis of the screw drive independently from the sharpening assembly or the bearing module; and comprising at least one element defining pre-determined opposing angular positions of the clamping mechanism; and a monolithic base slidingly supporting the bearing module at a controlled distance from the axis of rotation of the clamping mechanism and having one or more indexers releaseably securing the clamping mechanism in the pre-determined opposing angular positions, the base having a sliding scale for defining said controlled distance.

2. The blade sharpener of claim 1, wherein the bearing module is slidingly secured to the base and comprises a spherical bearing having a clear opening providing the clearance fit to the guiding rod.

3. The blade sharpener of claim 1, wherein jaws of the clamping mechanism comprise compressible inserts, said insets partially embedded in the jaws and adapted for enhancing a friction-based contact with the blade.

4. The blade sharpener of claim 1, wherein the clamping mechanism is controllably spring-loaded against the base along the axis of rotation of the clamping mechanism.

5. A blade sharpener, comprising:

a sharpening assembly including an abrasive stone unit and a guiding rod coupled to the abrasive stone unit;

a bearing module adapted to pivotally support and provide a clearance fit to the guiding rod;

a clamping mechanism adapted to receive, grip, and release a blade, said clamping mechanism rotateable about an axis substantially coplanar with an axis of the guiding rod; and a base adapted to:

rotateably secure the clamping mechanism in at least one pre-determined position; and slidingly support the bearing module at an adjustable distance from an axis of rotation of the clamping mechanism, wherein:

the base has a J-shape form factor;

the clamping mechanism is supported by openings formed in opposing short and long vertical sides of the base; and the bearing module is moveably secured in a cutout in the long vertical side of the base.

6. The blade sharpener of claim 5, wherein the clamping mechanism comprises a threaded shaft extending through said openings and a jaw assembly disposed external to said short vertical side of the base and coupled to a first end of the threaded shaft.

7. The blade sharpener of claim 6, wherein the jaw assembly is operable using a threaded member disposed on the threaded shaft between the short and long vertical sides of the base.

8. The blade sharpener of claim 5, wherein a second end of the threaded shaft is controllably spring-loaded against said long vertical side of the base using a spring disposed on the threaded shaft.

9. The blade sharpener of claim 1, wherein the abrasive stone unit includes a first handle adapted for engaging an abrasive stone, tangentially with respect to the blade, in repetitive translational, lateral, or harmonic movements, said first handle disposed oppositely to a working surface of the abrasive stone.

10. The blade sharpener of claim 1, further comprising a second handle detachably affixed to the base, said second handle adapted for rotational coupling said blade sharpener to a stationary support and/or for supporting said blade sharpener by hand.

* * * * *